US011541262B2

(12) United States Patent
Kjellman

(10) Patent No.: US 11,541,262 B2
(45) Date of Patent: Jan. 3, 2023

(54) CONTROL MECHANISMS FOR FIRE SUPPRESSION SYSTEMS

(71) Applicant: Carrier Corporation, Farmington, CT (US)

(72) Inventor: Thomas Kjellman, Uxbridge, MA (US)

(73) Assignee: Carrier Corporation, Palm Beach Gardens, FL (US)

( * ) Notice: Subject to any disclaimer, the term of this patent is extended or adjusted under 35 U.S.C. 154(b) by 448 days.

(21) Appl. No.: 16/758,276

(22) PCT Filed: Oct. 24, 2018

(86) PCT No.: PCT/US2018/057304

§ 371 (c)(1),
(2) Date: Apr. 22, 2020

(87) PCT Pub. No.: WO2019/084132

PCT Pub. Date: May 2, 2019

(65) Prior Publication Data

US 2020/0338376 A1 Oct. 29, 2020

Related U.S. Application Data

(60) Provisional application No. 62/578,181, filed on Oct. 27, 2017.

(51) Int. Cl.
*A62C 37/42* (2006.01)
*A62C 2/24* (2006.01)

(52) U.S. Cl.
CPC ..... *A62C 37/42* (2013.01); *A62C 2/242* (2013.01)

(58) Field of Classification Search
CPC ..... A62C 37/48; A62C 37/42; A62C 3/006; A62C 2/242; A62C 37/10; A62C 37/11;
(Continued)

(56) References Cited

U.S. PATENT DOCUMENTS 3,378,081 A * 4/1968 O'Reilly ..... A62C 37/42 169/17
3,463,236 A * 8/1969 Andersen ..... A62C 37/12 169/59

(Continued)

FOREIGN PATENT DOCUMENTS

EP 2907546 A1 8/2015

OTHER PUBLICATIONS

International Search Report issued in PCT/US2018/057304, dated Jan. 29, 2019.

*Primary Examiner* — Justin M Jonaitis
(74) *Attorney, Agent, or Firm* — Locke Lord LLP; Joshua L. Jones; Gabrielle L. Gelozin

(57) ABSTRACT

A control mechanism includes an actuator having first and second positions, a resilient member arranged to bias the actuator toward the second position, and an input cable. The input cable is arranged along a serpentine path and is connected to the actuator, the input cable arranged to retain the actuator in the first position using tension applied by a plurality of detector cables along the serpentine path of the input cable. Fire detector connector modules, fire suppression systems, and methods of integrating detector cables into control mechanisms are also described.

16 Claims, 5 Drawing Sheets

(58) Field of Classification Search
CPC . A62C 37/12; F16K 17/383; Y10T 137/1639; Y10T 137/1797
USPC ..... 169/57, 7, 42
See application file for complete search history.

(56) References Cited

U.S. PATENT DOCUMENTS

| | | | | | |
|---|---|---|---|---|---|
| 3,884,304 | A * | 5/1975 | Messerschmidt | A62C 35/605 | 340/517 |
| 4,313,501 | A * | 2/1982 | Eckert | A62C 37/12 | 222/83.5 |
| 4,889,313 | A * | 12/1989 | Sanchez | F16K 31/465 | 251/74 |
| 6,186,604 | B1 * | 2/2001 | Fikse | B62D 55/253 | 305/180 |
| 6,286,604 | B1 | 9/2001 | Ou | | |
| 2011/0214888 | A1 * | 9/2011 | Alchalel | A62C 37/36 | 169/46 |
| 2015/0231432 | A1 * | 8/2015 | Zlatintsis | A62C 37/46 | 169/61 |

* cited by examiner

CONTROL MECHANISMS FOR FIRE SUPPRESSION SYSTEMS

CROSS-REFERENCE TO RELATED APPLICATIONS

This application is a U.S. National Phase Application filed under 35 U.S.C. § 371, based on International Patent Application No. PCT/US2018/057304, filed Oct. 24, 2018, which claims priority to U.S. Patent Provisional Application No. 62/578,181, filed on Oct. 27, 2017. The entire contents of these applications are incorporated herein by reference.

BACKGROUND OF THE INVENTION

1. Field of the Invention

The present disclosure relates to fire suppressions systems, and more particularly to control mechanisms for fire suppression systems having multiple detector cable inputs.

2. Description of Related Art

Fire suppression systems commonly include a suppressant reservoir with an actuated valve and detection devices. The valve generally retains the suppressant in the reservoir until a fire event is detected, at which point the valve opens and suppressant issues into a space protected by the fire suppression system. Detectors are typically arranged within the protected space to respond to the presence of flame, smoke, and/or heat associated with a fire to cause actuation of the valve and release of suppressant into the protected space.

In some fire suppression systems, such as those in commercial kitchens, detectors cooperate with a control head to retain the suppressant within the suppressant reservoir by retaining tension in cables connecting the respective fire detectors with the control head. When one (or more) of the detectors recognizes a fire event the detector releases tension on the cable. The release of tension, or slackening of the cable, causes the control head to open the valve, which in turn allows the suppressant to enter the protected space. The control head generally has the capability to accommodate multiple cables routed to various detectors arranged within a protected space, typically by use of redundant actuation mechanisms within the control head.

Such redundant control heads have generally been considered satisfactory for their intended purpose but require increasing cost and complexity for each additional detector or control head. As fire suppression systems increase in size with respect to the amount of space protected and/or the number of detectors, it is desirable to reduce the cost and complexity of implementing and installing such complex systems.

SUMMARY OF THE INVENTION

A control mechanism includes an actuator having first and second positions, a resilient member arranged to bias the actuator toward the second position, and an input cable. The input cable is arranged along a serpentine path and is connected to the actuator, the input cable arranged to retain the actuator in the first position using tension applied by a plurality of detector cables along the serpentine path of the input cable.

In certain embodiments, the input cable can be is arranged to allow the actuator to move to the second position upon release of the tension communicated by the input cable. The control mechanism can include a housing and two or more detector cables. The serpentine path can extend with the housing. The tension can be communicated within the housing by the input cable. The detector cables can extend through the housing and connect to the input cable within the housing. The actuator can be pivotally supported within the housing interior. The actuator can be pivotally fixed outside the housing. The input cable can extend into the housing and connect to actuator in the housing.

In accordance with certain embodiments, a tensioner can be connected to the actuator. The tensioner can couple the input cable to the actuator. The actuator can include a single lever arm. Two or more cable guides can be arranged along the serpentine path of the input cable. A detector cable can connect to the input cable between a first and a second of the cable guides. No detector cables can be connected between a first and a second of the cable guides.

It is contemplated that, in accordance with certain embodiments, the input cable can be fixed to a fixation location within the housing. A system cartridge can be connected to a suppressant valve by a poppet and a conduit. The actuator can be operatively connected to the poppet valve for retaining pressurized gas within the system cartridge in the first position and communicating pressurized gas to the valve in the second position.

A module for integrating detector cables into a control mechanism includes an input cable, two or more input cable guides, and two or more detector cable couplers. The input cable is arranged for connection between an actuator and a fixation location. The input cable guides are arranged to retain the input cable along a serpentine path. The detector cable couplers are arranged to couple two or more detector cables to the input cable along the serpentine length of the input cable. In certain embodiments the module can include a housing with a fixation location arranged therein and having three or more apertures. An end of the input cable can be connected to the fixation location. The serpentine path can span two or more of the apertures. The detector cable guides can be arranged along the serpentine path on opposite sides of an aperture.

A fire suppression system includes a suppressant reservoir, a suppressant valve in fluid communication with the suppressant reservoir, and a control mechanism as described above. The actuator is operably connected to the suppressant valve to issue suppressant from the suppressant reservoir to a protected space when the actuator moves from the first position to the second position. In certain embodiments the fire suppression system can include a housing, a plurality of detector cables and a plurality of cable guides. The cable guides can be arranged along the serpentine path and the serpentine path can extend within the housing. The detector cables can extend through the housing and connect to the input cable within the housing and wherein the control mechanism can include only a single actuator.

A method of integrating detector cables into a control mechanism includes connecting an input cable to an actuator having first and second positions. A resilient member biases the actuator toward the second position and detector cables are connected to the input cable along a serpentine path. The detector cable applies tension to the input cable to retain the actuator in the first position. In certain embodiments, the actuator can be retained in the first position using the tension communicated by the input cable to the actuator. In accordance with certain embodiments the actuator can be allowed to move between the first position and the second position by reducing the tension communicated to the actuator by the input cable These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Conventional methods and fire suppression systems having multiple detector cable inputs have generally been considered satisfactory for their intended purpose. However, there is still a need in the art for improved control heads, fire suppression systems, and methods of coupling input cables to control heads in fire suppression systems. The present disclosure provides a solution for this need.

Figure 1:
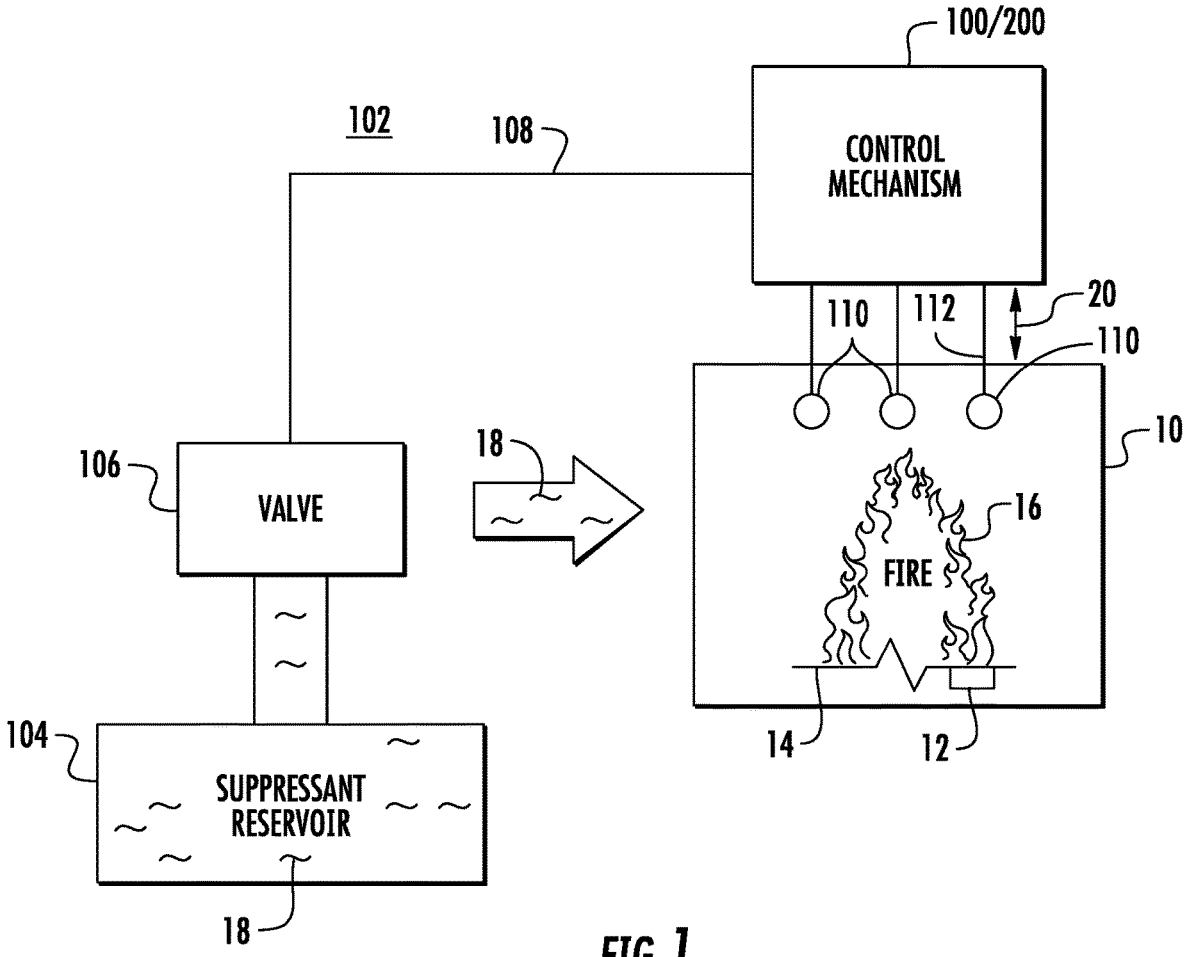
FIG. 1 is a schematic view of an exemplary embodiment of a fire suppression system constructed in accordance with the present disclosure, showing a control mechanism connected to a protected space by a plurality of fire detector cables.

Reference will now be made to the drawings wherein like reference numerals identify similar structural features or aspects of the subject disclosure. For purposes of explanation and illustration, and not limitation, a partial view of an exemplary embodiment of a control mechanism for a fire suppression system in accordance with the disclosure is shown in FIG. 1 and is designated generally by reference character 100. Other embodiments of control mechanisms, fire suppression systems, and methods of making control mechanisms for fire suppression systems in accordance with the disclosure, or aspects thereof, are provided in FIGS. 2-5, as will be described. The systems and methods described herein can be used coupling fire detector actuation cables to a fire suppression control mechanism, such as in control mechanisms having a single lever arm actuator, though the present disclosure is not limited to lever arm-type actuators control mechanisms or to fire suppression systems in general.

Referring to FIG. 1, a fire suppression system 102 is shown. Fire suppression system 102 includes a suppressant reservoir 104, a valve 106, an actuation conduit 108, and a plurality of fire detectors 110. Suppressant reservoir 104 retains a suppressant 18 suitable for suppression of fire 16 within a protected space 10. Protected space 10 has a fuel supply 12 and an ignition source 14. Protected space 10 can be, for example, a cooking area or an exhaust hood in a commercial kitchen or cooking area. Fuel supply 12 can be grease or cooking oil and ignition source 14 can be a fryer or stove. As will be appreciated by those of skill in the art, proximity of fuel supply 12 and ignition source 14 can result in fire 16. Fire suppression system 102 is arranged to suppress fire 16 in the event that ignition source 14 ignites fuel supply 12.

Valve 106 is arranged to selectively place suppressant reservoir 104 in fluid communication with protected space 10. In this respect valve 106 is in fluid communication with suppressant reservoir 104, e.g., via a suppressant conduit or via mounting to a pressure vessel, and has closed and open states. When in the closed state valve 106 fluidly isolates suppressant reservoir 104 from protected space 10. When in the open state valve 106 places suppressant reservoir 104 in fluid communication with protected space 10. Fluid communication between suppressant reservoir 104 and protected space 10 causes suppressant 18 to issue in to protected space 10, suppressing fire 16.

Actuation conduit 108 couples control mechanism 100 with valve 106 and is arranged to operate valve 106. In the exemplary embodiments described herein operation of valve 106 is pneumatic. In this respect actuation conduit 108 extends from control mechanism 100 to valve 106 to provide high pressure air to valve 106 upon detection of fire by one or more of fire detectors 110. Although illustrated herein in the context of a pneumatically actuated fire suppression system, it is to understood and appreciated that fire suppression systems with valve operated by other mechanisms, such as via direct mechanical engagement through a cable connecting directly to a valve member, can also benefit from the present disclosure.

Fire detectors 110 are arranged within or in proximity to protected space 10 and arranged to detect the presence of fire 16, such as by employment of a fusible link-type device. Each fire detector 110 is coupled to control mechanism 100 by a respective detector cable 112, which each apply a tensile load 20 to control mechanism 100 when fire 16 is not detected by the respective fire detector 110 connected to the detector cable 112, as will be described. It is contemplated that at least two detector cables 112 couple fire detectors 110 to control mechanism 100.

Figure 2:
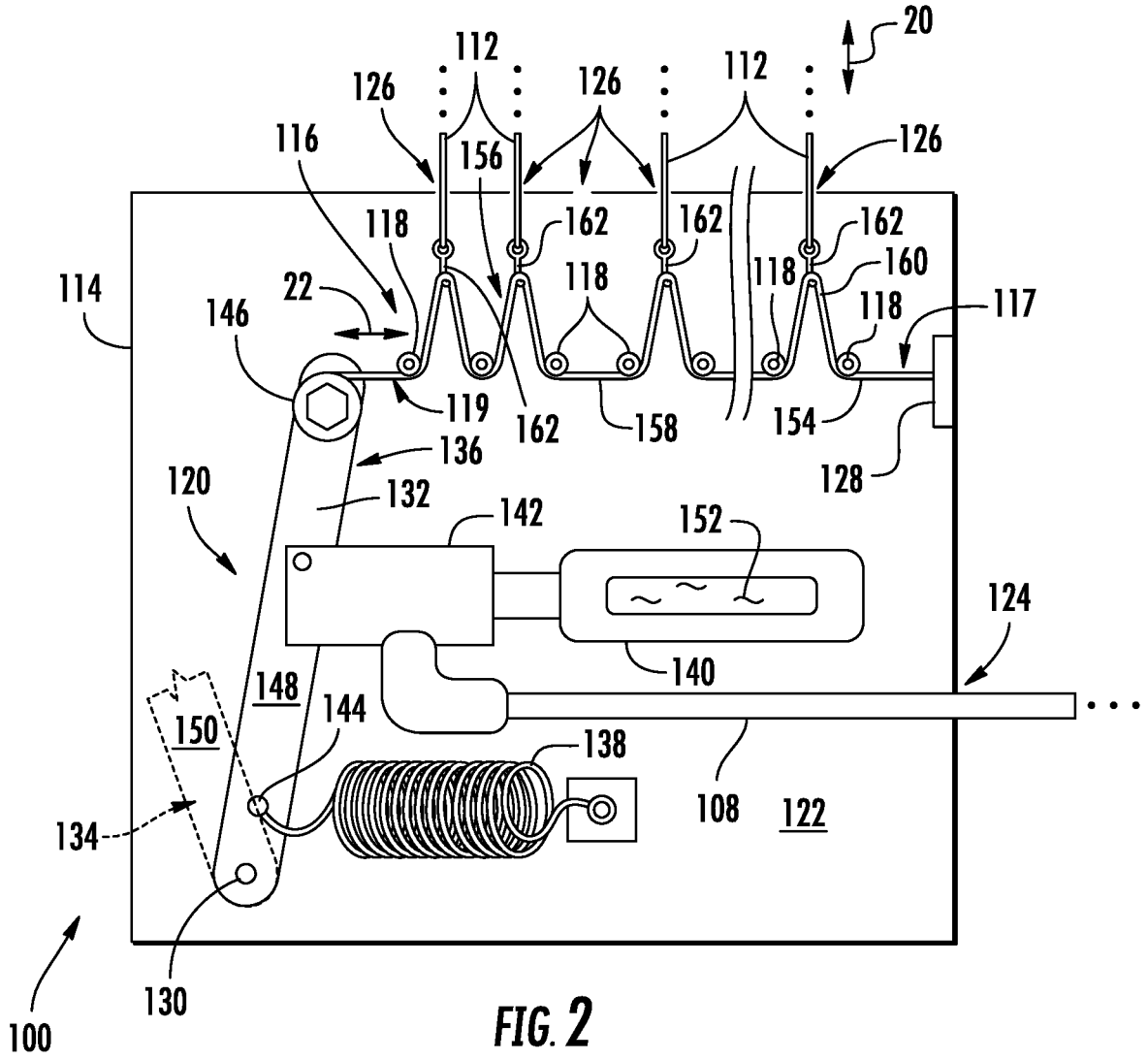
FIG. 2 is a schematic view of the control mechanism of FIG. 1 according to a first exemplary embodiment, showing the control mechanism with an actuator lever and input cable arranged within a common housing.

With reference to FIG. 2, control mechanism 100 is shown. Control mechanism 100 includes a housing 114, an input cable 116, a plurality of cable guides 118, and an actuator assembly 120 having an actuator 132. Housing 114 bounds a housing interior 122 and has an actuation conduit aperture 124 and a plurality of detector cable apertures 126. A fixation location 128 and a pivot 130 are arranged within housing interior 122. In the illustrated exemplary embodiment actuator 132 is pivotally fixed within housing 114.

Actuator assembly 120 includes actuator 132. In the illustrated exemplary embodiment actuator 132 is a lever arm-type actuator with a single lever arm. This is for illustration purposes only and is non-limiting. As will be appreciated by those of skill in the art in view of the present disclosure, other type of actuator including sprung valve members can benefit from the present disclosure.

In the illustrated exemplary embodiment actuator 132 has a pivot end 134 and an input cable end 136. Actuator assembly 120 additionally includes a resilient member 138, a system cartridge 140, and a poppet valve 142. Pivot end 134 of actuator 132 is pivotally supported within housing interior 122 at pivot 130. Resilient member 138 is fixed at one end within housing interior 122 and is connected at an opposite end to actuator 132 at a location 144 between pivot end 134 and input cable end 136 of actuator 132. A tensioner 146 is connected to input cable end 136 of actuator 132 and is arranged to adjust tension 22 applied to actuator 132 by input cable 116.

Poppet valve 142 is coupled to system cartridge 140 and is operably connected to actuator 132. In this respect poppet valve 142 is connected to actuator 132 at a location between pivot end 134 and input cable end 136 of actuator 132, and actuator 132 is arranged to place system cartridge 140 in fluid communication with actuation conduit 108 upon movement of actuator 132 from a first position 148 to a second position 150. Movement of actuator 132 from first position 148 to second position 150 in turn causes actuation conduit 108 to issue an actuation gas 152 to valve 106 (shown in FIG. 1) through actuation conduit 108, which extends through actuation conduit aperture 124 and is fluidly coupled to valve 106.

Cable guides 118 are arranged within housing interior 122 between tensioner 146 and fixation location 128. Input cable 116 is arranged along a serpentine path 156 and is connected to actuator 132 such that input cable 116 retains actuator 132 in first position 148 using tension applied by detector cables 112 along serpentine path 156, input cable 116 thereby communicating tension 22 to actuator 132. Input cable 116 is also arranged to allow actuator 132 to move to second position 150 upon release of tension 22 communicated by input cable 116 to actuator 132. Although described herein as tension high/valve closed actuator assembly, those of skill in the art will recognize that the present disclosure can also benefit tension low/valve actuator assemblies.

Input cable 116 extends between fixation location 128 and tensioner 146, a first end 117 of input cable 116 being connected to fixation location 128 and an opposite second end 119 of input cable 116 being connected to tensioner 146, input cable 116 being coupled therethrough to actuator 132. In certain embodiments input cable 116 is a single continuous length of cable 154, uninterrupted by intervening elements of fire suppression system 102 (shown in FIG. 1), and connected at opposite ends to fixation location 128 and actuator 132 for communicating tension applied to input cable 116 by detector cables 112 to actuator 132.

Input cable 116 spans at least one of the plurality of detector cable apertures 126 extending through housing 114. Detector cables 112 extend through respective detector cable apertures 126 and connect to input cable 116 along the length of input cable 116. Connection can be effected by way of couplers 162, for example hooks and/or eyelets, tension 20 carried by each of detector cables 112 cooperating with opposing forces exerted by cable guides 118 on input cable 116 to cause input cable 116 to trace a generally serpentine path 156 through housing interior 122. Serpentine path 156 can be irregular, input cable being straight along segments wherein no detector cables 112 connect between adjacent cable guides 118, e.g., segment 158, and serpentine path 156 having a triangular shape long segments where detector connect between adjacent cable guides 118, e.g., segment 160.

It is contemplated that input cable 116 be a single input cable connecting each detector cable 112 to actuator 132. Connection via singular input cable 116 allows for use of a single actuator 132 (and/or actuator assembly 120) in control mechanism 100, simplifying the arrangement of fire suppression system 102 (shown in FIG. 1). In the illustrated exemplary embodiment input cable 116 spans each of five (5) detection cable apertures 126 extending through housing 114 to receive tension 20 from each of four (4) detector cables 112, each detector cable 112 extending between a respective fire detector 110 (shown in FIG. 1) and input cable 116. This is for illustration purposes only and is non-limiting. As will be appreciated by those of skill in the art in view of the present disclosure, input cable 116 can couple fewer than four or more than four detector cables 112 to actuator 132, as suitable for an intended application. As will also be appreciated by those of skill in the art in view of the present disclosure, one or more of the detector cable apertures 126 may be unoccupied by a detector cable 112, as suitable for an intended application. Further, although an actuator-type control mechanism is shown in the illustrated exemplary embodiment, those of skill in the art will recognize in view of the present disclosure that other types of control mechanism can also benefit from the present disclosure.

Figure 3:
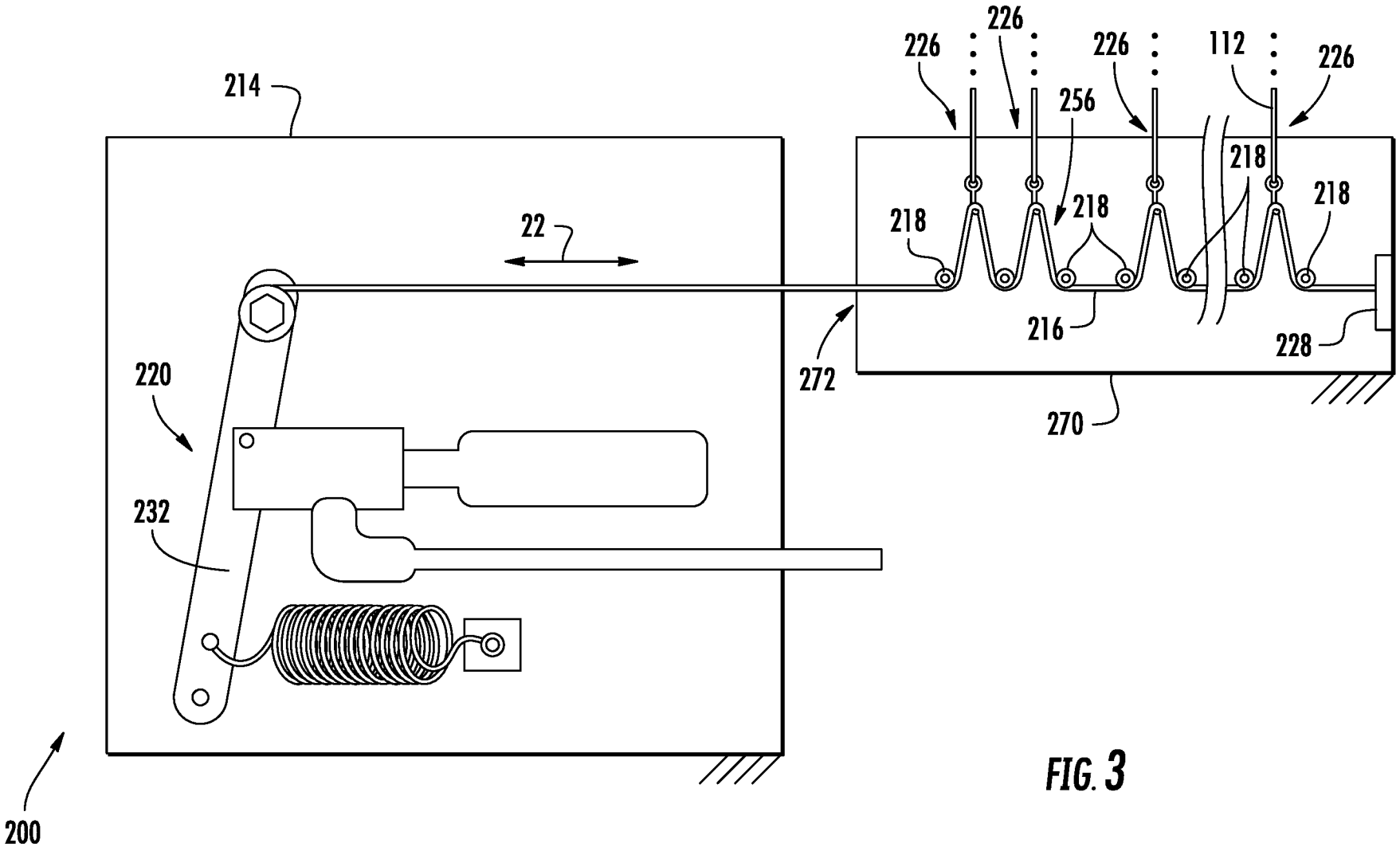
FIG. 3 is a schematic view of the control mechanism of FIG. 1 according to a second exemplary embodiment, showing a control mechanism with an actuator lever and input cable arranged within separate housings, according to an exemplary illustrative embodiment.

With reference to FIG. 3, a control mechanism 200 is shown. Control mechanism is 200 is similar to control mechanism 100 (shown in FIG. 1) and additionally includes an input cable 216 contained within a manifold housing 270. Manifold housing 270 is arranged to be fixed relative to a housing 214 containing actuator assembly 220, receive detector cables 112 through respective detector cable apertures 226, and communicate tension 22 via input cable 216 via a cable routing extending through both manifold housing 270 and housing 214. Actuator assembly 220 includes an actuator 232 pivotally fixed outside of manifold housing 270.

Manifold housing 270 has a fixation location 228 arranged therein and includes at least three apertures. A first of the apertures is an input cable aperture 272, through which input cable 216 extends to couple with actuator 232. The second and third apertures are detector cable apertures 226, through which detector cables 112 respectively extend and connect to input cable 216. Input cable 216 is connected on an end to fixation location 228 and traces a serpentine path 256 spanning two or more of detector cable apertures 226 with two or more cable guides 218 arranged along serpentine path 256 between input cable 216 and detector cable apertures 226. As will be appreciated be those of skill in the art in view of the present disclosure, use of a manifold housing 270 including input cable 216 allows a legacy control mechanism contained, e.g., contained within housing 214, to be converted into a multiple detector cable arrangement without having to add additional actuator assemblies 220 to accommodate additional detector cables.

Figure 4:
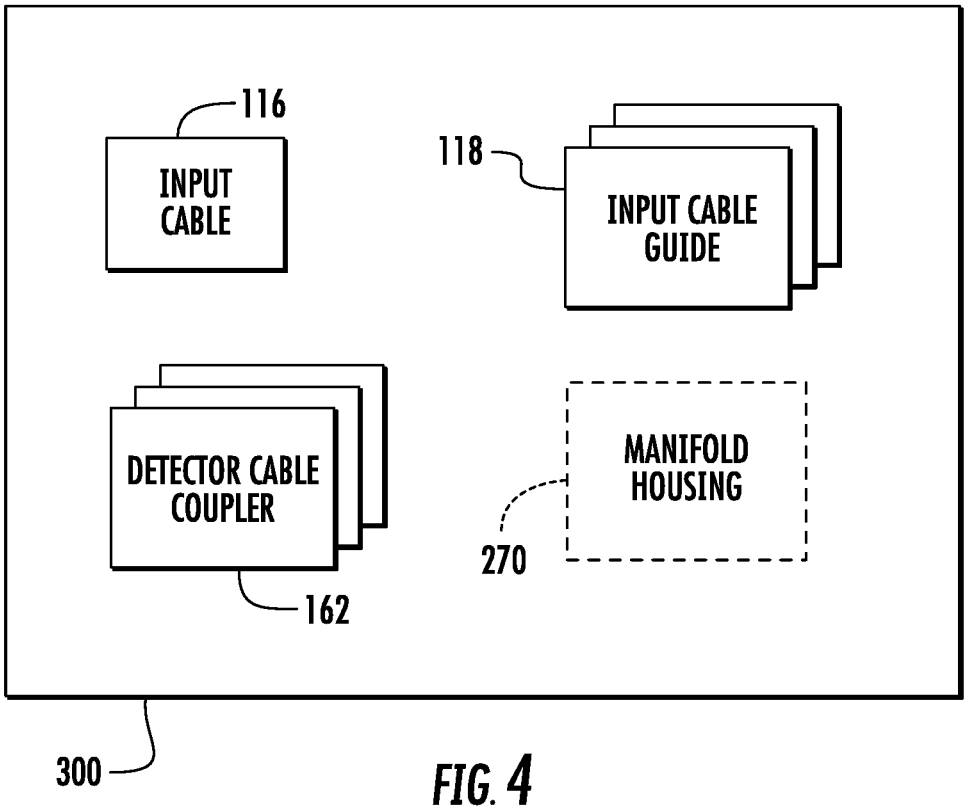
FIG. 4 is a diagram of a module for integrating detector cables into a control mechanism, showing the elements of the module.

With reference to FIG. 4, a detector cable connector module 300 for fire suppression control mechanism, e.g., control mechanism 100 (shown in FIG. 1) and/or control mechanism 200 (shown in FIG. 1), is shown. Module 300 includes input cable 116, two or more input cable guides 118, and two or more detector cable couplers 162. Input cable 116 is arranged for connection between actuator 132 (shown in FIG. 2) and a fixation location, e.g., fixation location 128 (shown in FIG. 2). Input cable guides 118 are each arranged to retain input cable 116 along a serpentine path, e.g., serpentine path 156 (shown in FIG. 2), for example by fixation within an interior of a control mechanism housing such as housing 114 (shown in FIG. 2) or manifold housing 214 (shown in FIG. 3). Detector cable couplers 162 are arranged to couple two or more detector cables 112 (shown in FIG. 1) to input cable 116 along serpentine path 156 of input cable 116. In certain embodiments, module 300 includes manifold housing 270.

Figure 5:
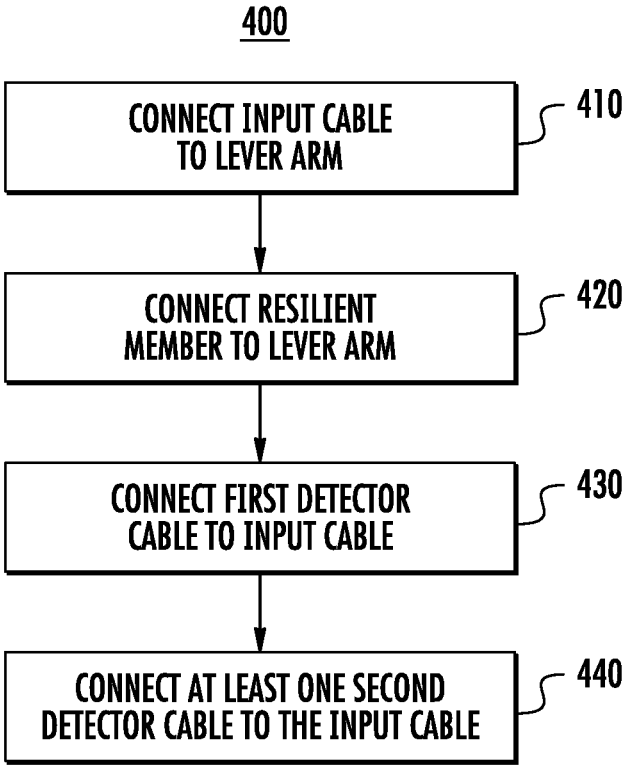
FIG. 5 is a block diagram of a method of integrating two or more detector cables into a control mechanism, showing operations of the method.

With reference to FIG. 5, a method 400 of integrating detector cables into a control mechanism, e.g., control mechanism 100 (shown in FIG. 1), is shown. Method 400 includes connecting an input cable, e.g., input cable 116 (shown in FIG. 2), to an actuator 132 (shown in FIG. 2) having first and second positions, as shown with box 410. Method 400 also includes connecting resilient member, e.g., resilient member 138 (shown in FIG. 2), to the actuator and biasing the actuator to the actuator second position, as shown with box 420. Method 400 additionally includes connecting a first detector cable, e.g., detector cable 112 (shown in FIG. 1), to the input cable such that the input cable coupled the detector cable to the actuator and applies tension, e.g., tension 22 (shown in FIG. 2), thereto, as shown with box 430.

Method 400 further includes connecting at least one second detector cable to the input cable and applying additional tension to the input cable, as shown with box 440, to retain the actuator in the actuator first position, e.g., first position 148 (shown in FIG. 2). It is contemplated that the actuator can be retained in the first position using the tension communicated by the input cable to the actuator. It is also contemplated that the actuator can be allowed to move between the first position and the second position, e.g., second position 150 (shown in FIG. 2), by reducing the tension communicated to the actuator by the input cable In some fire suppression systems, such as in commercial kitchens, release of the fire suppression system can be initiated by loss of tension in actuation cables tie into the internal mechanism of a control box. While some control boxes have the ability to accommodate multiple actuation cable inputs, such control boxes generally require employment of additional control mechanisms to accommodate the additional actuation cables. This can increase the cost and complexity of the control box and/or the fire suppression system.

In embodiments described herein a single input cable accommodates more than one actuation cable by coupling each actuation cable to the input cable, and therethrough to the fire suppression system control mechanism. In certain embodiments any number of actuation cables can be connected to the input cable, tension applied by the actuation cables causing the input cable to trace a serpentine path and which goes slack in the event that tension on any one of the actuation cables is released. As will be appreciated by those of skill in the art in view of the present disclosure, slack in the input cable, in turn, allows the control mechanism to move and ultimately actuate the fire suppression system. In certain embodiments described herein the input cable can be incorporated into an adapter, enabling retrofit of legacy control mechanisms for increasing the number of actuation cables accommodated by a single control mechanism. Similarly, control mechanisms for fire suppression systems described herein can also accommodate additional detector cables while retaining the orientation of the input cable as originally installed, because the detector cables can be angled, e.g., obliquely or orthogonally, relative to the input cable.

It is contemplated that the present disclosure can simplify the control mechanism of fire suppression systems by allowing multiple actuation cable inputs to be coupled to a single control mechanism, e.g., without having to add an additional lever assembly. This can reduce the cost that otherwise results when additional actuation cables are added to a fire suppression system by reducing (or eliminating entirely) the need for additional redundant mechanisms to the control mechanism. It can also reduce the complexity that otherwise accompanies adding control mechanisms as there is no choice as to which mechanism a given detector cable is to be coupled to, each detector cable instead being coupled to a common control mechanism through the input cable. Further, when packaged within an adapter, e.g., a manifold housing, the input cable can provide the capability to an existing control mechanism to accommodate additional actuation cable inputs without replacement of the legacy control mechanism.

The methods and systems of the present disclosure, as described above and shown in the drawings, provide for control mechanisms, fire suppression systems, and methods of making fire suppression systems with superior properties including simplified control mechanisms for fire suppression systems having multiple detector cables. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A control mechanism, comprising:

an actuator having first and second positions;

a resilient member arranged to bias the actuator toward the second position; and an input cable arranged along a serpentine path and connected to the actuator, wherein the input cable is arranged to retain the actuator in the first position using tension, applied by a plurality of detector cables along the serpentine path of the input cable, and communicated to the actuator by the input cable;

a housing and a plurality of detector cables, wherein the serpentine path extends within the housing, wherein the plurality of detector cables extend through the housing and connect to the input cable within the housing; and a first end of the input cable is fixed to a fixation location arranged within the housing.

2. The control mechanism as recited in claim 1, wherein the actuator is pivotally fixed within the housing and the input cable connects to the actuator within the housing.

3. The control mechanism as recited in claim 1, wherein the actuator is pivotally fixed outside of the housing, wherein the input cable extends through the housing and connects to the actuator outside of the housing.

4. The control mechanism as recited in claim 1, wherein the actuator includes a lever arm.

5. The control mechanism as recited in claim 1, wherein the actuator includes a single lever arm.

6. The control mechanism as recited in claim 1, further comprising a plurality of cable guides arranged along the serpentine path of the input cable.

7. The control mechanism as recited in claim 6, further comprising a detector cable connected to the input cable between a first and a second of the cable guides.

8. The control mechanism as recited in claim 6, wherein no detector cables connect to the input cable between a first and a second of the cable guides.

9. The control mechanism a recited in claim 1, further comprising a tensioner fixed to the actuator and coupling the input cable to the actuator.

10. The control mechanism as recited in claim 1, further comprising a system cartridge connected to a valve by an actuation conduit and a poppet valve, wherein the actuator is operatively connected to the poppet valve to retain compressed gas within the system cartridge in the first position and to issue the compressed gas from the system cartridge to the valve through the actuation conduit in the second position.

11. The control mechanism as recited in claim 1, wherein the input cable is arranged to allow the actuator to move to the second position upon release of the tension communicated by the input cable within the housing.

12. A module for integrating detector cables into a control mechanism, comprising:

an input cable arranged for connection between an actuator and a fixation location;

a plurality of cable guides arranged to retain the input cable along a serpentine path;

a plurality of couplers arranged to couple two or more detector cables to the input cable along the serpentine length of the input cable; and a housing with the fixation location and at least three apertures, wherein an end of the input cable is connected to the fixation location, wherein the serpentine path spans at least two of the apertures, and wherein a first and a second of the plurality of cable guides are arranged on opposite sides of a first of the apertures along the serpentine path.

13. A fire suppression system, comprising:

a suppressant reservoir;

a suppressant valve in fluid communication with the suppressant reservoir; and a control mechanism operably connected to the suppressant valve, including:

an actuator having first and second positions;

a resilient member arranged to bias the actuator toward the second position; and an input cable arranged along a serpentine path and connected to the actuator, the input cable arranged to retain the actuator in the first position using tension, applied by a plurality of detector cables along the serpentine path, and communicated to the actuator by the input cable to issue suppressant from the suppressant reservoir to a protected space when the actuator moves from the first position to the second position; and a housing, a plurality of detector cables, and a plurality of cable guides, the input cable arranged within the housing, the cable guides fixed within the housing along the serpentine path, and detector cables coupled to the input cable along the serpentine path.

14. A method of integrating detector cables into a control mechanism, comprising:

providing a housing;

connecting an input cable to a fixation location within the housing and an actuator having first and second positions;

biasing the actuator toward the second position using a resilient member; and connecting a plurality of detector cables to the input cable along serpentine path, each of the detector cables applying tension to the input cable to retain the actuator in the first position.

15. The method of making a fire suppression system as recited in claim 14, further comprising retaining the actuator in the first position using tension communicated by the input cable to the actuator.

16. The method of making a first suppression system as recited in claim 14, further comprising allowing the actuator to move to the second position by reducing tension communicated to the actuator by the input cable.

* * * * *